US009048548B2

(12) United States Patent
Palmer et al.

(10) Patent No.: US 9,048,548 B2
(45) Date of Patent: Jun. 2, 2015

(54) AIRCRAFT MISSILE LAUNCHER COVER

(71) Applicant: The Boeing Company, Chicago, IL (US)

(72) Inventors: Todd J. Palmer, Lake Saint Louis, MO (US); Thaddeus M. Jakubowski, Jr., St. Charles, MO (US); Cory Gordon Keller, St. Charles, MO (US); Steven Michael Schoen, Crestwood, MO (US); Richard Raymond Kreutzman, Jr., St. Charles, MO (US); Daniel DiDomenico, St. Louis, MO (US); Aaron Ross Cowin, O'Fallon, MO (US); Gregory M. Sisti, Florissant, MO (US); Samuel Jerome Huhman, Hazelwood, MO (US); Mike Heller, Wildwood, MO (US); Daryl D. Carpenter, Wildwood, MO (US); David Michael Paruleski, Shumway, IL (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/052,874

(22) Filed: Oct. 14, 2013

(65) Prior Publication Data

US 2015/0101478 A1 Apr. 16, 2015

(51) Int. Cl.

| | |
|---|---|
| ***F41F 3/04*** | (2006.01) |
| ***H01Q 15/14*** | (2006.01) |
| ***F41F 7/00*** | (2006.01) |
| ***F41F 3/06*** | (2006.01) |
| ***H01Q 17/00*** | (2006.01) |

(52) U.S. Cl.
CPC *H01Q 15/14* (2013.01); *F41F 7/00* (2013.01); *F41F 3/0406* (2013.01); *F41F 3/06* (2013.01); *H01Q 17/00* (2013.01)

(58) Field of Classification Search
CPC ..... F41F 3/077; F41F 3/0406; F41F 3/042; F41F 3/052; F41F 7/00; F41F 3/06; F41F 3/065; B64D 1/04; B64D 7/08; B64D 7/00; H01Q 17/00; H01Q 15/14
USPC ..... 89/36.11, 1.819
See application file for complete search history.

(56) References Cited

U.S. PATENT DOCUMENTS

| | | | | | |
|---|---|---|---|---|---|
| 2,802,396 | A | * | 8/1957 | Montgomery | 89/1.51 |
| 3,040,629 | A | * | 6/1962 | Duncan et al. | 89/1.806 |
| 3,838,425 | A | * | 9/1974 | Ishimitsu et al. | 342/2 |
| 4,545,284 | A | * | 10/1985 | Piesik | 89/1.819 |
| 4,660,456 | A | | 4/1987 | Griffin et al. | |
| 4,711,151 | A | | 12/1987 | Griffin et al. | |
| 4,750,404 | A | | 6/1988 | Dale | |
| 5,148,734 | A | | 9/1992 | Lilly | |
| 5,497,691 | A | | 3/1996 | Graham | |
| 5,831,200 | A | * | 11/1998 | Fisch | 89/1.819 |

(Continued)

*Primary Examiner* — Joshua Freeman
(74) *Attorney, Agent, or Firm* — Ostrager Chong Flaherty & Broitman P.C.

(57) ABSTRACT

A cover for an empty rail missile launcher that can be used in flight. The cover is shaped to reflect radar signals transmitted by a radar transmitter away from the radar transmitter to reduce detectibility by radar. The cover may also be coated with radar absorbent material to reduce detectibility by radar. Hangers are used to mount the cover to the rail missile launcher. The cover is provided with a grounding mechanism to dissipate precipitation static. A restraint mechanism is provided to prevent the cover from inadvertently sliding off the rail missile launcher.

18 Claims, 8 Drawing Sheets

(56) References Cited

U.S. PATENT DOCUMENTS

| | | | | |
|---|---|---|---|---|
| 5,979,826 | A * | 11/1999 | Brown et al. | 244/121 |
| 6,543,328 | B1 | 4/2003 | Plummer et al. | |
| 7,997,180 | B2 * | 8/2011 | Soderberg | 89/1.819 |
| 8,333,138 | B2 * | 12/2012 | Garrison et al. | 89/1.819 |
| 8,662,449 | B2 * | 3/2014 | Shah et al. | 244/121 |
| 2004/0061029 | A1 * | 4/2004 | McCarthy | 244/199 |
| 2006/0249630 | A1 * | 11/2006 | McCarthy | 244/199.4 |
| 2009/0223356 | A1 * | 9/2009 | Soderberg | 89/1.819 |
| 2011/0133031 | A1 * | 6/2011 | Shah et al. | 244/119 |
| 2012/0060674 | A1 * | 3/2012 | Garrison et al. | 89/1.819 |

* cited by examiner

AIRCRAFT MISSILE LAUNCHER COVER

TECHNICAL FIELD

This disclosure generally relates to a cover for an aircraft missile launcher and, more particularly, to a flightworthy cover for an empty rail missile launcher that reduces the radar cross section of the aircraft.

BACKGROUND

Air-to-air and air-to-ground missiles are typically mounted on missile launchers that are affixed to hard points on the fuselage or wings of an aircraft. Missile launchers fall into two categories, ejection type missile launchers such as the LAU-142 manufactured by the EDO Corporation and rail missile launchers such as the LAU-127 manufactured by the Marvin Group.

A rail missile launcher or "rail launcher" generally has attachment points on top for affixing the rail launcher to the aircraft and launch rails on the bottom for mounting the missile. Launch rails have guide slots or tracks that run longitudinally along the length of the launch rails. A missile is typically loaded on a rail launcher by slidably engaging the tracks with corresponding rails, hooks, or hangers located on the missile and then sliding the missile onto the launch rails. For example, the AIM-9 series of Sidewinder missiles is loaded onto LAU-127 rail launchers by engaging "T-hangers" on the Sidewinder with tracks on the LAU-127. When the missile is launched, the missile slides forward along the tracks until it flies clear of the aircraft towards the target.

In order to prevent the missile from inadvertently sliding off the rail launcher during flight, take-off, and landing, rail launchers typically have restraint mechanisms such as stops or detents that engage corresponding stops on the missile to prevent the missile from sliding off. The detents are lowered or retracted out of the way when the missile is being loaded, unloaded, or launched from the rail launcher. Rail launchers may also have grounding mechanisms for dissipating precipitation static or P-static. P-static is created when rain, snow, hail, dust, or other particles strike the surfaces of the aircraft. If not dissipated, P-static can damage the aircraft and its electronics.

Some missions do not require an aircraft to carry missiles. During such missions the rail launchers may be empty. Empty rail launchers typically have a large flat area, sharp angles, and cavities that reflect radar signals back to the radar transmitter. This increases the radar cross section of the aircraft, making it more detectible by radar. Rail launchers may be removed when a particular mission requires an aircraft to be less detectible by radar but does not require missiles. However, some aircraft are not allowed to fly without rail launchers attached. For example, the F/A-18 Hornet fighter jet is not allowed to fly without rail launchers attached to its wingtips even if a particular mission does not require missiles. Also, current procedures for removing and re-installing rail launchers are complicated, labor intensive and time-consuming. Moreover, rail launchers can be damaged during the process of removal and re-installation.

It is known in the art that an object can be made less detectible by radar to provide "stealth" capabilities by shaping the object's surface so that radar signals striking the object are reflected away from the radar transmitter. This lowers or reduces the object's radar cross section and therefore, its detectibility by radar. One way this is done is by eliminating or reducing the number of large flat areas, cavities, and sharp angles that reflect radar signals back to the radar transmitter.

This technique was used in the Lockheed Martin F-117 Nighthawk jet fighter. Unlike the large flat panels found in regular aircraft, the fuselage and wings of the F-117 Nighthawk consisted of numerous small flat panels called "facets" that were angled to deflect radar signals striking the aircraft away from the radar transmitter. Radar cross section can also be reduced by smoothing the surfaces, as long as such smoothing does not create reflections towards the radar transmitter.

Another method known in the art for reducing the radar detectibility of an object is the use of radar absorbent material or "RAM" in the manufacture of the object or to cover the object. Examples of radar absorbent materials include but are not limited to carbon, carbon fiber composites, or magnetic ferrite-based substances. Use of RAM reduces the amount of radar signals reflected back to the radar transmitter thereby reducing radar detectibility. Radar absorbent material was used by the F-117 Nighthawk, which was coated with a paint containing tiny iron balls ("iron ball paint") that absorbed radar energy.

It can be seen from the foregoing that a need exists for a cover for an empty rail missile launcher that reduces radar detectibility, is flightworthy and easy to install and remove without causing any damage to the rail launcher. As used herein, the term "flightworthy" means that the cover meets standard requirements for allowing the cover to be used while airborne or in flight.

SUMMARY

The foregoing purposes, as well as others that will be apparent, are achieved generally by a flightworthy cover for a rail missile launcher that has a reduced radar cross section and a method that reduces the radar detectibility of an empty rail launcher by reflecting radar signals away from the radar transmitter and/or by absorbing the radar signals transmitted by the radar transmitter. The cover uses hangers for slidably mounting and attaching the cover onto the rail launcher. The cover is also provided with restraint and grounding mechanisms. In accordance with one method, a flightworthy cover having a reduced radar cross section is provided for the rail missile launcher. The cover is adapted for slidably mounting and attaching to the rail missile launcher using hangers. Other objects, features, and advantages of the present disclosure will be apparent when the detailed description is considered in conjunction with the following drawings.

BRIEF DESCRIPTION OF THE DRAWINGS

Various embodiments will be hereinafter described with reference to drawings for the purpose of illustrating the foregoing and other aspects of the disclosure.

DETAILED DESCRIPTION

Various embodiments will be hereinafter described with reference to drawings for the purpose of illustrating the foregoing and other aspects of the disclosure.

Figure 1:
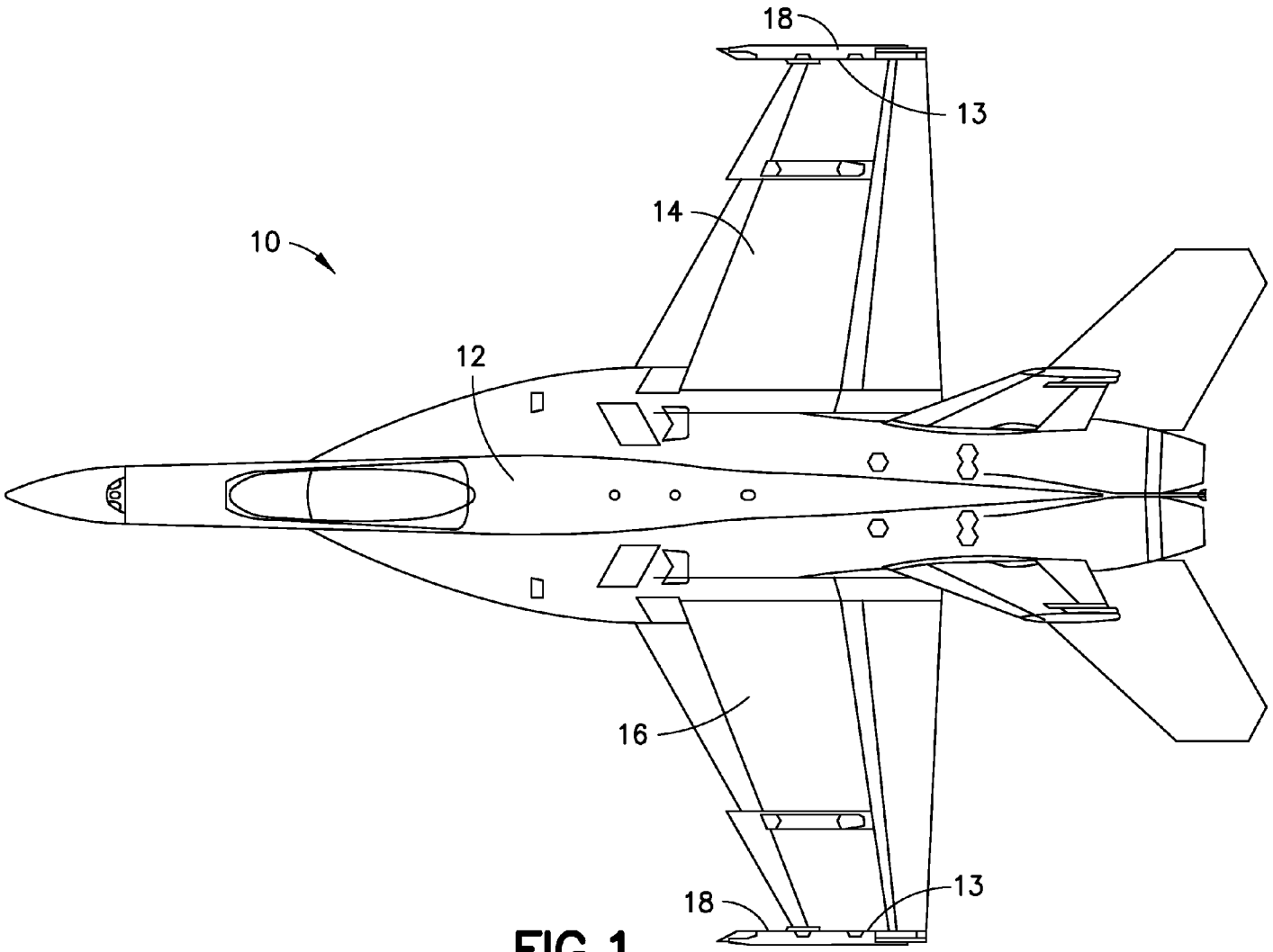
FIG. 1 is plan view of an aircraft with an empty rail launcher mounted on each wingtip.
Figure 2:
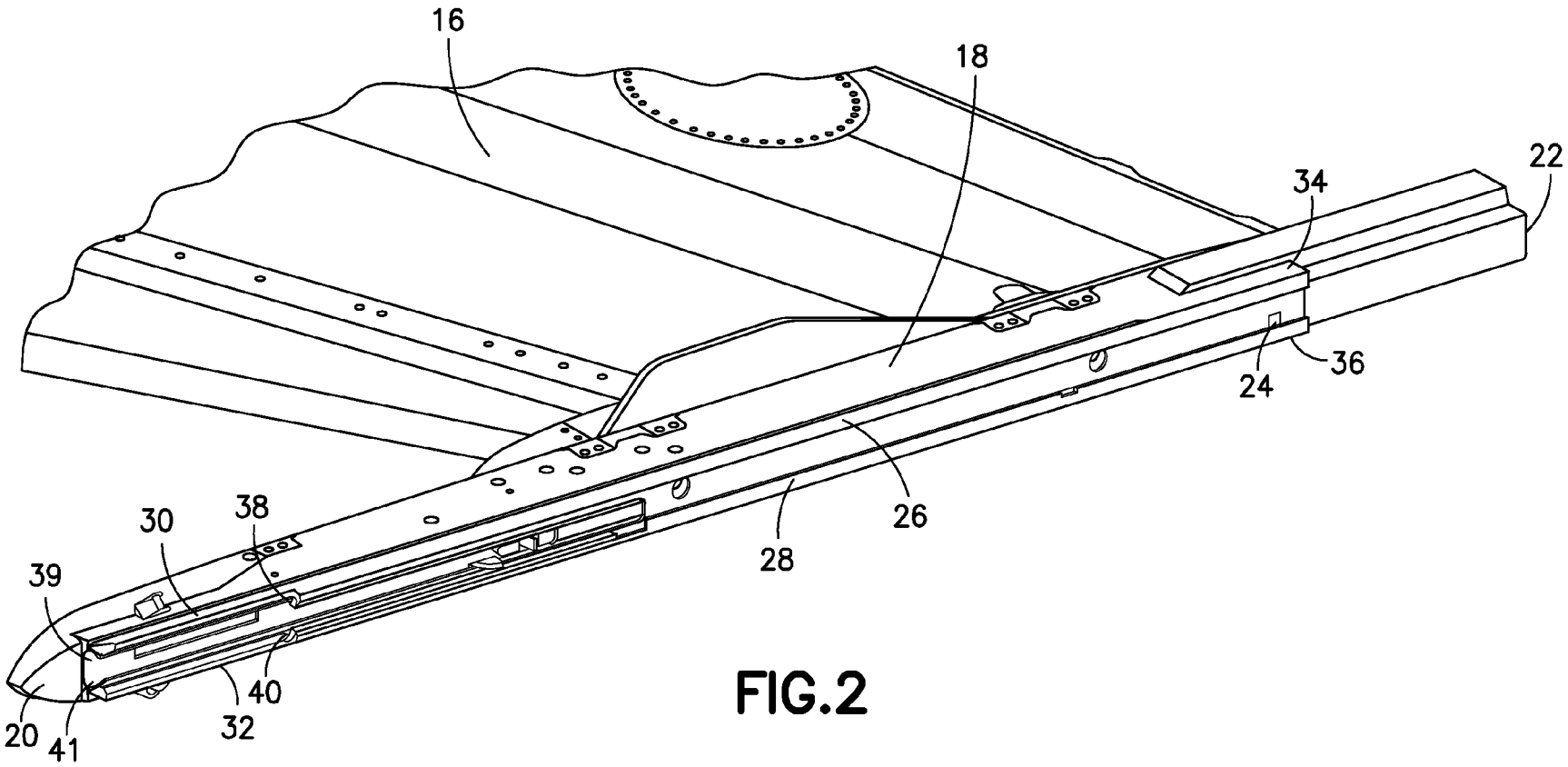
FIG. 2 is a perspective view of the rail launcher and left wingtip of the aircraft of FIG. 1.

FIG. 1 depicts an aircraft 10 having a fuselage 12, wings 14, 16 and empty rail launchers 18 mounted on the tips 13 of each of the wings 14, 16. Alternatively, rail launchers 18 can be mounted below wings 14, 16 or on fuselage 12. As shown in FIG. 2, rail launcher 18 includes a launcher forward end 20, a launcher aft end 22, a restraint detent 24, and launch rails 26, 28. Launch rails 26, 28 have rail forward ends 30, 32, rail aft ends 34, 36, and guide tracks 38, 40 running longitudinally along the length of each launch rail 26, 28. There are also forward tracks 39, 41 running along the length of rail forward ends 30, 32.

Figure 3:
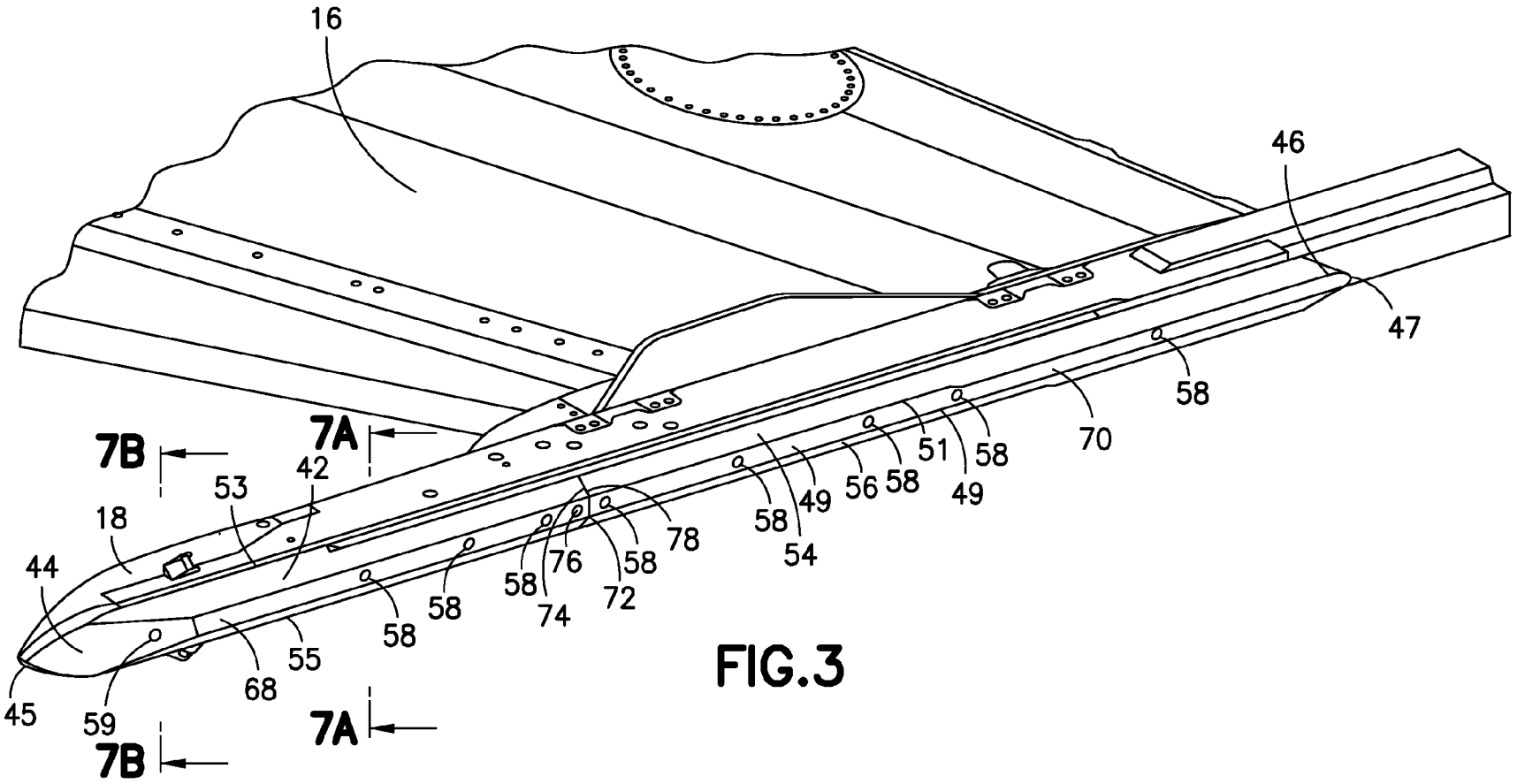
FIG. 3 is a perspective view of a cover mounted on the rail launcher of FIG. 2.

Referring to FIGS. 2-3, a flightworthy cover 42 with reduced radar cross section is adapted to be slidably mounted and secured to launch rails 26, 28 using a forward hanger 60 and cover hangers 62 (FIG. 4) to provide rapid and efficient installation and removal of cover 42 from rail launcher 18. As set forth below, cover 42 is shaped to reflect radar signals away from the radar transmitter and may be covered by a material that absorbs radar signals transmitted by the radar transmitter.

Figure 4:
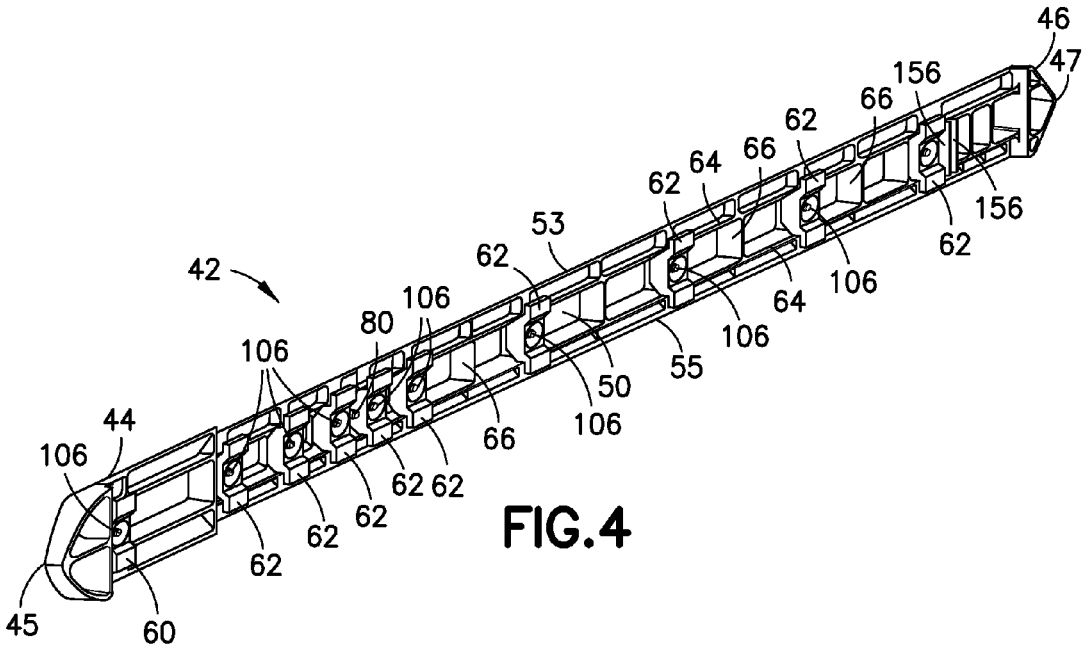
FIG. 4 is a perspective view of the inner or inboard side of the cover of FIG. 3.
Figure 5:
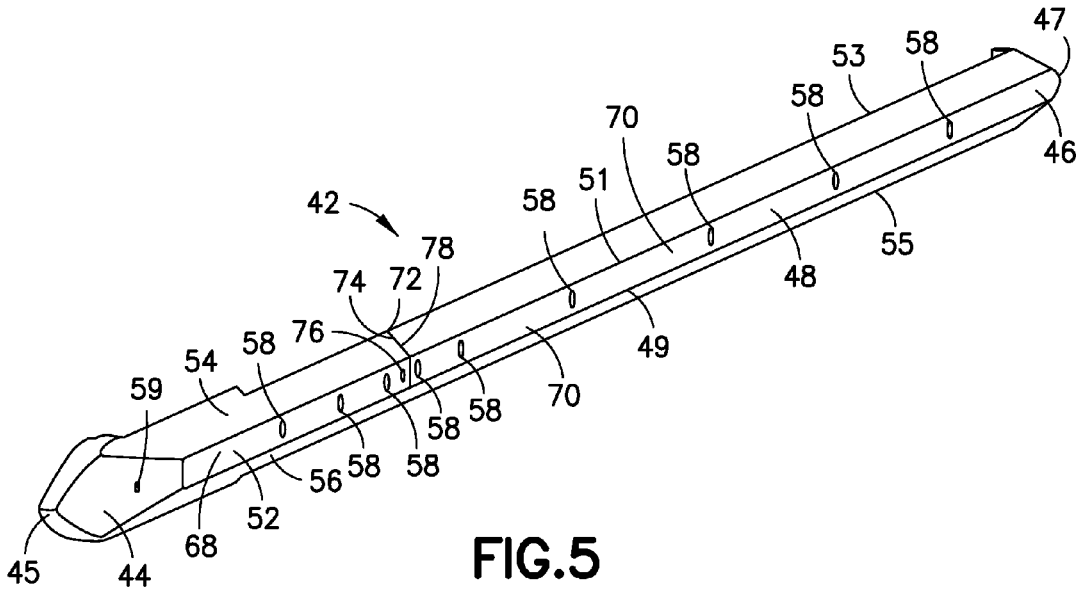
FIG. 5 is a perspective view of the outer or outboard side of the cover of FIG. 4.

Referring to FIGS. 3-5, cover 42 includes a cover forward end 44, a cover aft end 46, an outboard side 48, an inboard side 50, a center web 52, an upper side 53, a lower side 55, and cover flanges 54, 56. Cover holes 58 (FIG. 3) are spaced apart along the length of center web 52 and used for securing the cover 42 to the rail launcher 18. As used herein, "inboard" means facing in the direction of aircraft 10 (FIG. 1) while "outboard" means facing away from aircraft 10. Cover 42 also has forward hanger 60 in forward end 44 on inboard side 50 adjacent to cover hole 59 (FIGS. 3, 4) in forward end 44 and cover hangers 62 disposed along the remaining length of inboard side 50 adjacent to cover holes 58.

As shown in FIG. 4, longitudinal stiffeners 64 run along the length of inboard side 50 while transverse stiffeners 66 run along the height of inboard side 50. Transverse stiffeners 66 are disposed perpendicular to and across longitudinal stiffeners 64. Stiffeners 64, 66 strengthen cover 42 and allow it to be thinner and lighter while remaining strong.

Cover 42 (FIGS. 3-5) is generally rectangular with parallel sides 53, 55 and forward and aft ends 44, 46 that taper to points 45, 47. Center web 52 is generally rectangular with a planar surface, parallel center web sides 49, 51 and flanges 54, 56 extending longitudinally outwards from center web sides 49, 51. Viewed from the front (FIG. 7A), the cross-sectional shape of cover 42 resembles a triangle wherein flanges 54, 56 form the legs of the triangle and center web 52 forms a flattened vertex oriented in an outboard direction. The flattened triangle shape reduces the area of flat surface exposed to radar signals and helps reflects radar signals away from the radar transmitter. In the present embodiment, flanges 54, 56 are disposed at an acute angle of about 45 degrees below the planar surface of center web 52. In other embodiments, depending on the anticipated reference plane of the radar transmitter, the cover flanges may be disposed at other acute angles. Alternatively, instead of a flattened triangle shape, the cross-section of the cover may be in the shape which matches the contours of the launcher or aligns with other features of the aircraft.

Referring to FIGS. 3-5, cover 42 of the illustrated embodiment comprises a forward section 68 and an aft section 70 that are connected together at a splice joint 72. In other embodiments the cover may consist of three or more sections connected at several splice joints or only a single unitary section. Forward section 68 has an aft edge 74 and a splice hole 76 located adjacent to splice joint 72. Aft section 70 has a forward edge 78 and a flat rectangular splice tab (not shown) with a tab hole (not shown). The splice tab is located on inboard side 50 adjacent to forward edge 78. The splice tab is disposed parallel to center web 52 and projects forward at a distance from forward edge 78 and across splice joint 72 so that the tab hole is located below and concentric with splice hole 76. A splice fastener lock (not shown) such as a nut is affixed over the tab hole on the inboard side of the splice stab. Aft edge 74 overlaps the splice tab and is in face-to-face engagement or contact with forward edge 78. A splice fastener 80 such as a screw, pin or bolt placed through splice hole 76 and the tab hole and into the splice fastener lock holds forward section 68 and aft section 70 together.

Cover hanger 62 (FIGS. 6, 7A) is generally shaped in the form of a rectangular block having a hanger outboard side 82, edge sides 84, 86, side walls 88, 90, hanger flanges 92, 94, a cavity 98, and a hanger hole 100. Cover hanger 62 (FIG. 6) also has a cutout or channel 96 to reduce the weight of hanger 62. A hanger fastener lock 102 such as a nut is located inside cavity 98 and held in place with a cavity fastener 104 such as a rivet. Cover hanger 62 (FIG. 7A) is connected to cover 42 by a hanger fastener 106 such as a bolt or screw placed through cover hole 58 and hanger hole 100 and into fastener lock 102. Referring to FIGS. 2 and 7A, flanges 92, 94 are slidably engageable into tracks 38, 40 enabling cover 42 to longitudinally slide along launch rails 26, 28. As discussed in more detail below, this allows cover 42 to be slidably installed and removed from rail launcher 18. Tightening together fasteners 106 and fastener locks 102 moves hangers 62 and cover 42 towards each other like a vise, thereby clamping cover 42 to rail launcher 18.

Forward hanger 60 (FIG. 7B) is generally similar in shape to cover hanger 62 and also has flanges 118, 120. However, forward hanger 60 differs from cover hanger 62 in that distal ends 130, 132 of flanges 118, 120 are rounded. In contrast (FIG. 7A), distal ends 138, 140 of flanges 92, 94 cover hanger 62 are square-shaped. As explained below, in the present embodiment, cover 42 is adapted for mounting on an LAU-127 rail launcher. The LAU-127 rail launcher has curved track outlines in forward tracks 39, 41 of rail forward ends 30, 32. The rounded-shape of the distal ends 130, 132 (FIG. 7B) allows forward hanger 60 to conform to the curved outline of forward tracks 39,41 in rail forward ends 30, 32 of the LAU-127 rail launcher 18. Other than this difference in shape of distal ends 130, 132, forward hanger 60 is otherwise identical to cover hanger 62, is connected to cover 42 with a fastener 106 and lock 102 in the same way as cover hanger 62, and operates in the same manner as cover hanger 62.

Referring the FIG. 7A, fastener 106 and lock 102 securely connects cover hanger 62 to cover 42 but can be easily loosened to allow hanger 62 and cover 42 to be spread apart so that flanges 92, 94 can be slidably inserted into tracks 38, 40. This enables cover 42 to be slidably mounted on launch rails 26, 28. The simple clamping procedure whereby fastener 106 and lock 102 are tightened to clamp and secure cover 42 to rail launcher 18 minimizes damage to rail launcher 18 and eliminates any need to modify rail launcher 18 to allow cover 42 to be secured thereon. Also, the use of a simple fastener 106 and lock 102 arrangement obviates the need for special tools to mount or remove cover 42 from rail launcher 18. In addition, since fastener 106 and lock 102 only have to be loosened in order to mount or remove cover 42 from rail launcher 18, the mounting and removal process is easier and faster since there is no need to attach or re-attach cover hangers 62 to cover 42 every time cover 42 is mounted or removed from rail launcher 18. Further, using only a single fastener 106 to connect each cover hanger 62 to cover 42 reduces weight.

As discussed in more detail below, cover 42 is attached to rail launcher 18 by slidably mounting cover 42 on launch rails 26, 28. Referring to FIG. 7A, this procedure is enabled by flanges 92, 94 which are adapted to slidably engage tracks 38, 40 in the same manner as the hangers of a missile. Thus, rail launcher 18 does not have to be modified to allow cover 42 to be slidably mounted thereon. In addition, the slideable mounting procedure for attaching cover 42 to rail launcher 18 is similar to the slideable mounting procedure used by ground crews to load and unload a missile from rail launcher 18. Thus, it is easier to train ground crew to mount and remove cover 42 from rail launcher 18.

Figure 6:
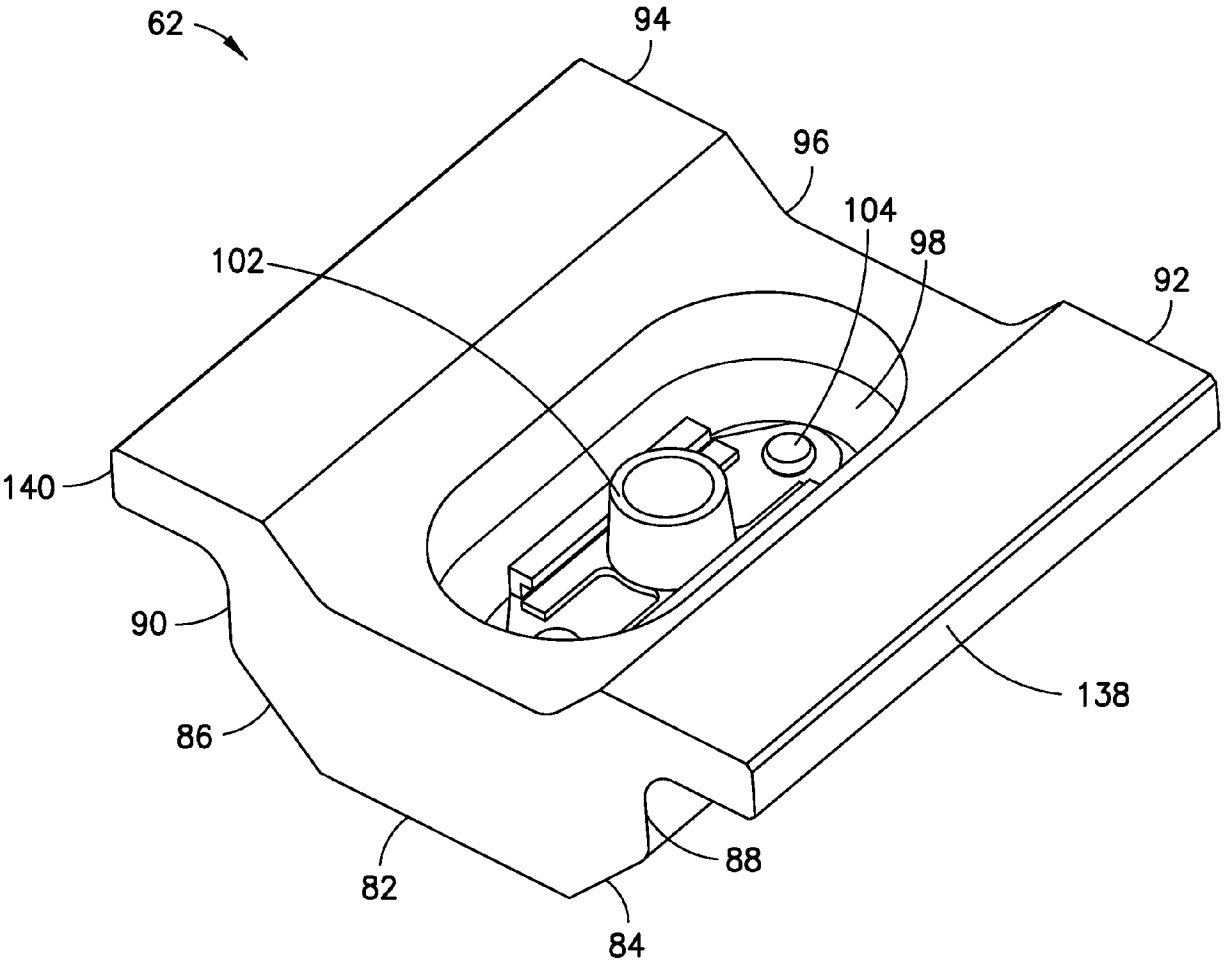
FIG. 6 is a perspective view of a cover hanger of the cover of FIG. 4.
Figure 7A:
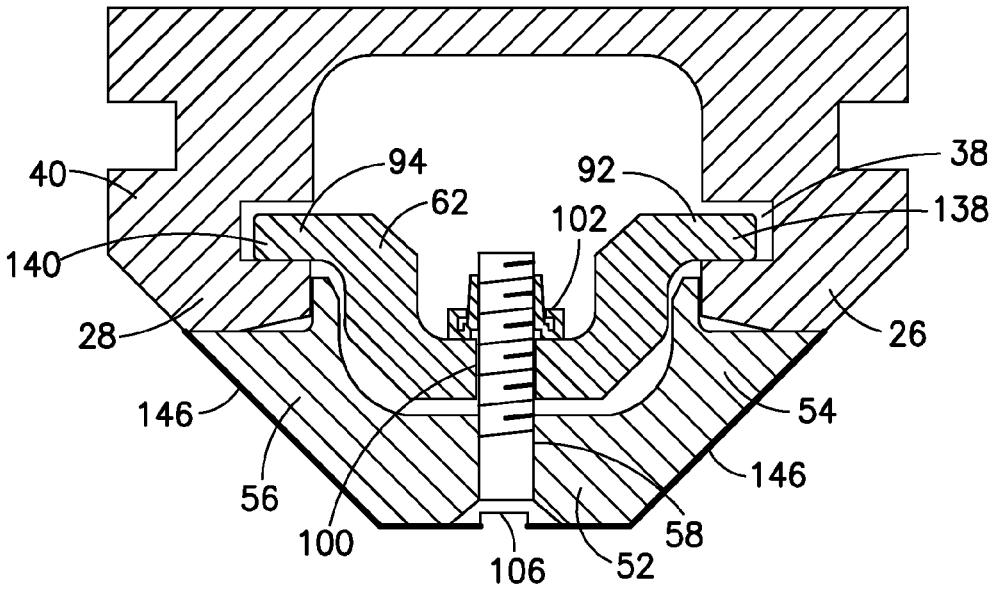
FIG. 7A is a cross-sectional view of the cover and rail launcher of FIG. 3 taken along line 7A-7A.

Referring to FIGS. 4-7B, the illustrated embodiment of cover 42 weights about 10 pounds and is about 108 inches long. Forward section 68 is about 35.01 inches long and about 3.61 inches wide while aft section 70 is about 73.71 inches long and about 2.93 inches wide. Center web 52 is about 0.12 inches thick while cover flanges 54, 56 are about 0.10 inches thick. Longitudinal and transverse stiffeners 64, 66 are between about 0.08 to about 0.12 inches thick. Referring to FIGS. 6 and 7A, cover hanger 62 is about 2 inches long and about 2.25 inches wide. Hanger 62 is about 0.84 inches thick measured from outboard side 82 to the bottom of channel 96. Flanges 92, 94 are about 0.20 inches thick and about 0.25 inches wide. As explained below, the foregoing dimensions enable mounting of cover 42 to an LAU-127 rail launcher. However, the foregoing dimensions can be adjusted to accommodate mounting cover 42 on other rail launchers models. In the illustrated embodiment, cover 42 and hangers 60, 62 are machined from 7075-T7351 aluminum bar stock. In other embodiments, the cover and hangers can be made from other materials such as steel, titanium, composites, and plastics. Instead of machining, the cover and hangers can be made by made by welding, casting, 3-D printing, extrusion, and sintered powdered metal. In the present embodiment, fasteners 80, 106 are 3M1169C4 Inconel 718 fasteners while the splice fastener lock (not shown) and locks 102 are ST3M719 self-locking plate nuts. In other embodiments, the fasteners can be MS or NAS standard fasteners.

The particular shape, dimensions, composition, weight, and method of manufacture of the cover and hangers, as well as the particular kind of fasteners and holders used, depend on several factors. These factors include the model or manufacturer of the rail launcher, frequency of the radar signals, weight restrictions, cost, maintenance requirements, aircraft to which the cover and rail launcher will be mounted, military specifications, operational environment, and flight certification requirements among others. In the illustrated embodiment (FIGS. 3-7B), the shape, dimensions, composition, weight and method of manufacture of cover 42 and hangers 60, 62 enable cover 42 to meet the requirements necessary for mounting cover 42 on an LAU-127 rail launcher that is attached to the wingtips of the F/A-18 Super Hornet fighter jet.

Figure 7B:
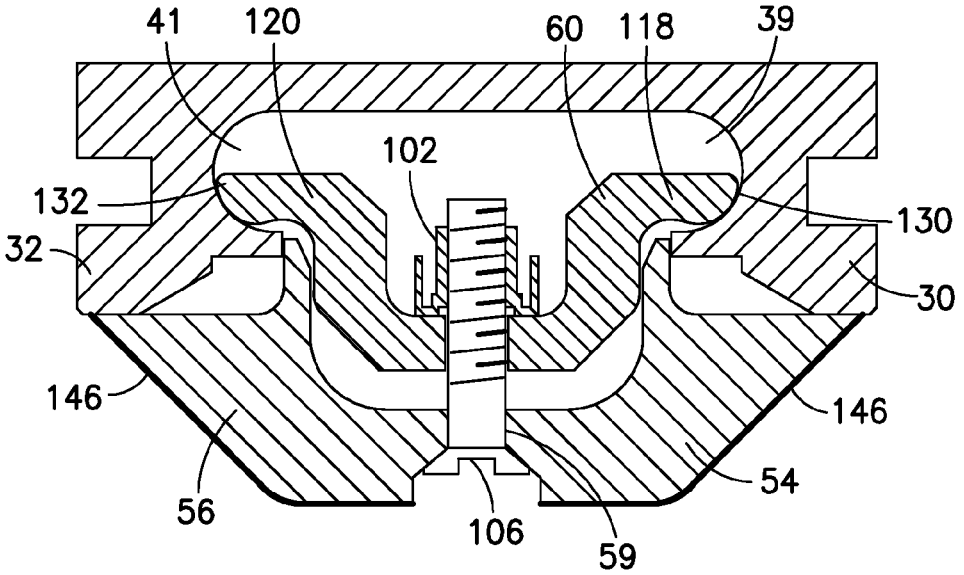
FIG. 7B is a cross-sectional view of the cover and rail launcher of FIG. 3 taken along line 7B-7B.

Referring to FIGS. 7A-7B, cover 42 may be coated with a layer of radar absorbent material 146 on outboard side 48, which may be spray-applied to the outboard side 48. The particular type of radar absorbent material used depends on factors such as frequency of the radar, maintenance requirements, cost, weight restrictions, corrosion, military specifications, operational environment and flight requirements. Examples of radar absorbing material are "iron ball" paint, neoprene polymer sheets or tiles embedded with ferrite grains or conductive carbon black particles. The particular method of applying radar absorbing material to cover 42 depends on the kind of radar absorbing material used as well as the same factors affecting the choice of radar absorbing material.

Figure 8:
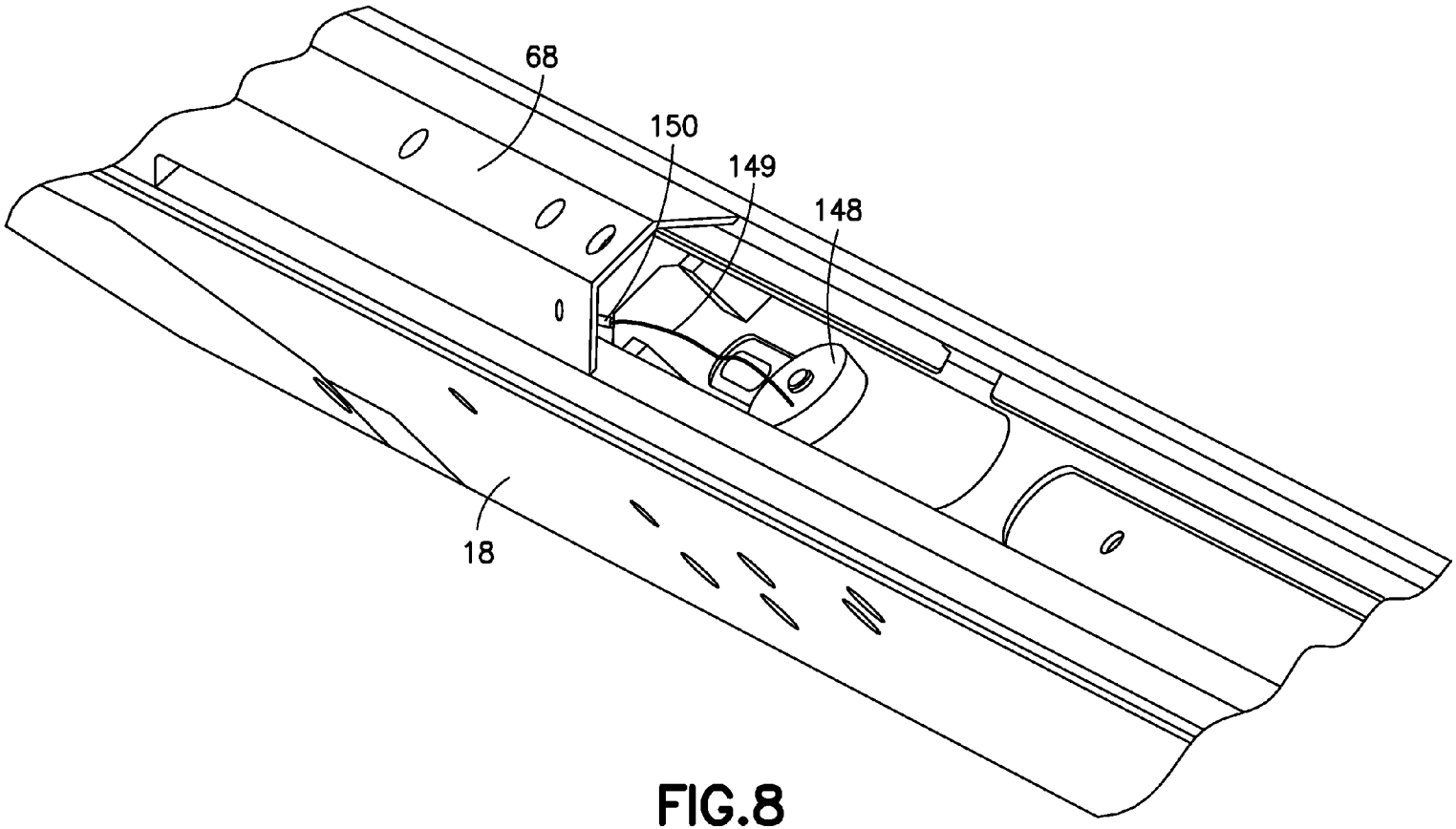
FIG. 8 is the perspective view of the hanger and cover of FIG. 3 with an aft section of the cover not yet mounted on the rail launcher.

Cover 42 is also provided with a grounding mechanism for dissipating "P-static". Referring to FIG. 8, the grounding mechanism consists of a grounding element 148 that is connected to rail launcher 18 and a cover terminal 150 connected to cover 42. A wire 149 connecting grounding element 148 to cover terminal 150 conducts static electricity from the cover to the launcher where it is dissipated. In the illustrated embodiment, grounding element 148 is a grounding disk made of a woven cotton fabric substrate impregnated and bonded with phenolic resin matrix that plugs into a receptacle (not shown) in rail launcher 18. In the present embodiment, the receptacle is the electrical interface connector between the aircraft and an AIM-120 missile while cover terminal 150 is a fastener such as a screw or bolt connected to forward section 68. In other embodiments, the grounding mechanism may consist of wire or a strap connected to the rail missile launcher.

Cover 42 is also provided with a restraint mechanism for preventing cover 42 from inadvertently sliding off rail launcher 18 during flight, take-off, and landing. Referring to FIGS. 2 and 4, the restraint mechanism consists of a pair of parallel restraint tabs 156 located on inboard side 50 of aft section 70. Restraint tabs 156 are adapted to engage restraint detent 24 between tabs 156 and prevent longitudinal movement of cover 42 along rail launcher 18.

Referring to FIGS. 2-5 and 7A-7B, in order to mount cover 42 to rail launcher 18, restraint detent 24 is lowered and fasteners 106 loosened sufficiently to allow hangers 60, 62 to fit into tracks 39, 41 and 38, 40 respectively. Aft edge 74 of forward section 68 is placed adjacent to forward end 20 of rail launcher 18 and moved rearward until flanges 92, 94 enter tracks 38, 40. Forward section 68 is then slid rearwards along track 38, 48 until flanges 118, 120 enter tracks 39, 41 and cover forward end 44 reaches rail forward end 30, 32. Grounding element 148 is plugged into the receptacle of rail launcher 18. Forward edge 78 of aft section 70 is then placed adjacent to aft end 22 of rail launcher 18 and moved forward until flanges 92, 94 enter tracks 38, 40. Aft section 70 is moved forward until forward edge 78 contacts aft edge 74 and splice hole 76 is aligned with the tab hole. Splice fastener 80 is placed through splice hole 76 and the tab hole and into the splice fastener lock and tightened. Fasteners 106 are tightened and restraint detent 24 raised to secure the cover to the rail launcher. In order to remove cover 42 from rail launcher 18, the foregoing procedure is done in reverse order.

Figure 9:
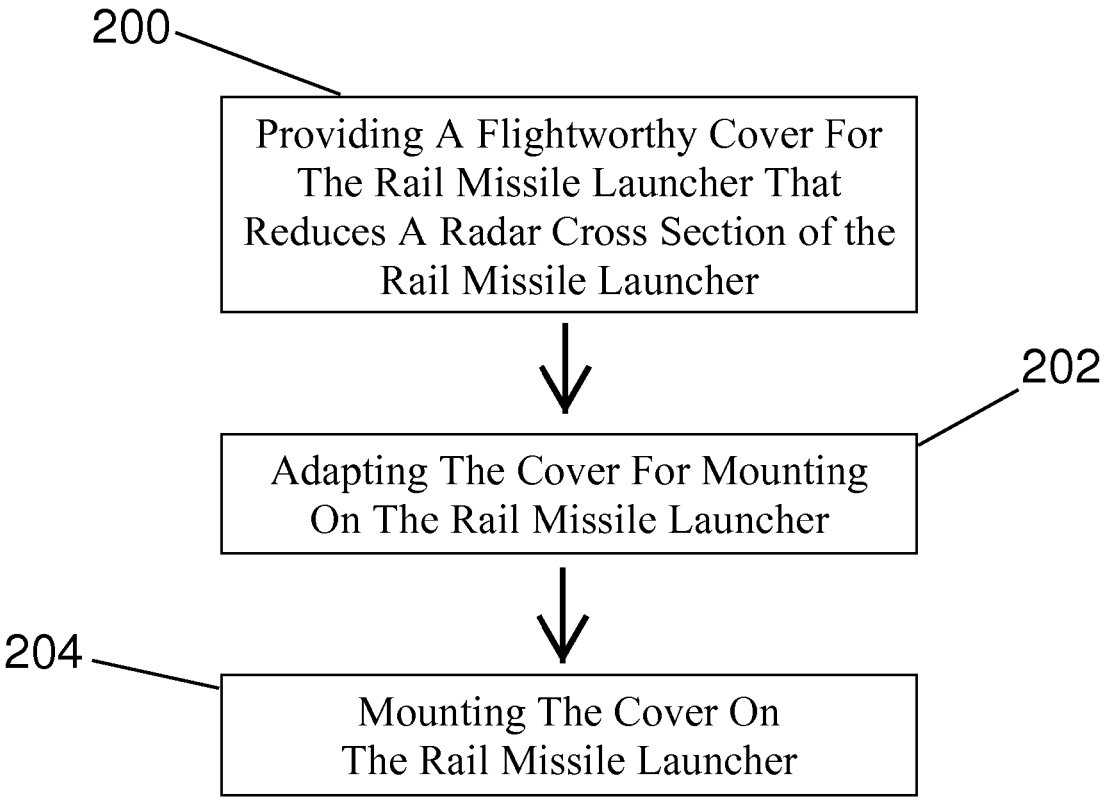
FIG. 9 is a flow chart illustrating the steps of a method for reducing the detectibility of a rail missile launcher by radar.

FIG. 9 illustrates a method for reducing the detectibility of a rail missile launcher by radar. The first step 200 consists of providing a flightworthy cover for the rail missile launcher that reduces a radar cross section of the rail missile launcher. In the second step 202, the cover is adapted for mounting on the rail launcher. Finally, in step 204 the cover is mounted on the rail launcher as previously described. In one embodiment, providing a cover 200 with reduced radar cross section comprises shaping the cover to reflect radar signals away from a radar transmitter. Providing a cover 200 may also include covering an outer surface of the cover with radar absorbent material.

While the invention has been described with reference to certain exemplary embodiments, such embodiments are for purposes of illustration and not limitation. It will be understood by those skilled in the art that various changes may be made and equivalents may be substituted for elements thereof without departing from the scope of the invention. In addition, many modifications may be made to adapt a particular situation to the teachings herein without departing from the essential scope thereof Therefore it is intended that the claims not be limited to the particular embodiments disclosed. The method claims set forth hereinafter should not be construed to require that the steps recited therein be performed in alphabetical order or in the order in which they are recited, and should not be construed to exclude two or more steps being performed contemporaneously during at least a portion of the duration of one of said steps.

The invention claimed is:

1. A cover for a rail missile launcher having a launch rail comprising: a flightworthy cover adapted for reducing a radar cross section of the missile launcher and a hanger for slidably mounting the cover on the launch rail.

2. The cover of claim 1, wherein the cover is shaped to reflect a radar signal transmitted by a radar transmitter away from the radar transmitter.

3. The cover of claim 1, wherein the cover is adapted to absorb a radar signal transmitted by a radar transmitter.

4. The cover of claim 3, wherein an outer surface of the cover comprises a radar absorbent material.

5. The cover of claim 3, wherein the cover comprises a radar absorbent material.

6. The cover of claim 1, wherein the launch rail has a guide track and the hanger is adapted to slidably engage the guide track.

7. The cover of claim 1, wherein the cover comprises:

a forward section;

an aft section; and a splice joint connecting the forward section to the aft section.

8. The cover of claim 1, further comprising:

a grounding mechanism for dissipating precipitation static, the grounding mechanism comprising:

a grounding element connected to the launcher;

a cover terminal connected to the cover; and a wire connecting the cover terminal to the grounding element.

9. The cover of claim 1, wherein the rail launcher includes a restraint detent, the cover further comprising: a restraint mechanism for engaging the restraint detent.

10. A method for reducing detectability of a rail missile launcher by radar comprising:

providing a flightworthy cover for the rail missile launcher that reduces radar cross section of the rail missile launcher; and providing a hanger for slidably mounting the cover to a launch rail of the rail missile launcher.

11. The method of claim 10, further comprising: applying a layer of radar absorbent material on an outer surface of the cover.

12. The method of claim 10, further comprising: providing a grounding mechanism for dissipating precipitation static.

13. The method of claim 10, further comprising: providing a restraint mechanism for preventing the cover from sliding off the cover.

14. A cover for a rail missile launcher, the cover comprising:

a flightworthy cover adapted for reducing a radar cross section of the rail missile launcher, comprising;

a forward section;

an aft section; and a splice joint connecting the forward section to the aft section;

a plurality of hangers adapted for slidably mounting the cover on a launch rail of the rail missile launcher;

a grounding mechanism; and a restraint mechanism.

15. The cover of claim 14, further comprising a layer of radar absorbent material covering an outer surface of the cover.

16. The cover of claim 14, wherein the forward section and the aft section is composed of a radar absorbent material.

17. The cover of claim 14, wherein the cover has an outboard side, the outboard side comprising:

a rectangular center web having a planar surface and parallel sides; and a flange extending outward along a length of each side at an acute angle below the planar surface.

18. The cover of claim 14, wherein the hanger comprises:

a flange adapted for slidably engaging a track of the launch rail; and a fastener for attaching the hanger to the cover.

* * * * *